US009759214B2

(12) United States Patent
Nuss et al.

(10) Patent No.: US 9,759,214 B2
(45) Date of Patent: Sep. 12, 2017

(54) SCREW PUMP WITH AT LEAST TWO PARTS

(71) Applicant: NETZSCH Pumpen & Systeme GmbH, Selb (DE)

(72) Inventors: Eduardo Nuss, Pomerode (BR); Arthur Zinke, Pomerode (BR); Aluisio Loth, Pomerode (BR); Klaus Heizinger, Pomerode (BR); Lorenz Lessmann, Pomerode (BR); Sérgio Krahn, Pomerode (BR); Rui Keunecke, Pomerode (BR); Silvio Beneduzzi, Blumenau (BR); Egon Weege, Pomerode (BR); Nilton André Theilacker, Timbo (BR); Sidney Guedes, Blumenau (BR); Petra Lutke, Pomerode (BR); Robert Kurz, Aschheim (DE); Josef Strassl, Straubing (DE); Johann Kreidl, Waldkraiburg (DE); Hisham Kamal, Waldkraiburg (DE); Horst Engl, Roth (DE); George Balcerczyk, Lisle (CA); Matthias Gradl, Sesslach (DE); Gunther Herr, Haarth (DE); Andre Nijmeh, Merkendorf (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 54 days.

(21) Appl. No.: 14/837,028

(22) Filed: Aug. 27, 2015

(65) Prior Publication Data

US 2015/0369239 A1 Dec. 24, 2015

Related U.S. Application Data

(63) Continuation of application No. PCT/DE2014/000088, filed on Feb. 25, 2014.

(30) Foreign Application Priority Data

Mar. 1, 2013 (DE) ..... 10 2013 102 031

(51) Int. Cl.
*F01C 1/16* (2006.01)
*F04C 2/16* (2006.01)
(Continued)

(52) U.S. Cl.
CPC ..... *F04C 2/16* (2013.01); *F01C 21/10* (2013.01); *F04C 15/06* (2013.01); *F04C 14/26* (2013.01)

(58) Field of Classification Search
CPC ..... F01C 21/10; F04C 14/26; F04C 15/06; F04C 2/16
See application file for complete search history.

(56) References Cited

U.S. PATENT DOCUMENTS 2,592,476 A * 4/1952 Sennet ..... F04C 2/165 417/201
2,924,181 A * 2/1960 Sennet ..... F04C 2/165 406/53

(Continued)

OTHER PUBLICATIONS

International Search Report Application No. PCT/DE2014/000088 Completed: Aug. 6, 2014; Mailing Date: Aug. 13, 2014 2 pages.

*Primary Examiner* — Jesse Bogue
(74) *Attorney, Agent, or Firm* — Whitmyer IP Group LLC

(57) ABSTRACT

A screw spindle pump constituted by at least two parts is disclosed. The first part includes a housing and at least one spindle system disposed in the housing and capable of being driven in a rotational manner. Furthermore, a pressure region disposed downstream of the spindle system and at least one outlet opening which is connected to the pressure region, the outlet opening discharging the delivery medium out of the pressure region. The second part includes at least one (Continued)

low-pressure chamber disposed upstream of the spindle system and at least one inlet opening for the delivery medium into the low-pressure chamber. The first part and the second part are coupled together, preferably in a rotational manner, so that they can assume at least two different relative positions.

12 Claims, 6 Drawing Sheets

(51) Int. Cl.

| | |
|---|---|
| ***F01C 21/10*** | (2006.01) |
| ***F04C 15/06*** | (2006.01) |
| *F04C 14/26* | (2006.01) |

(56) References Cited

U.S. PATENT DOCUMENTS

| | | | | |
|---|---|---|---|---|
| 3,759,636 | A * | 9/1973 | Schaefer | F04C 28/26 417/281 |
| 4,773,837 | A * | 9/1988 | Shimomura | F04C 2/084 418/180 |
| 2002/0037230 | A1 | 3/2002 | Sjoholm et al. | |
| 2013/0022458 | A1* | 1/2013 | Joistgen | F01C 21/02 415/215.1 |
| 2016/0186750 | A1* | 6/2016 | Walley | A22C 11/08 418/15 |

* cited by examiner

SCREW PUMP WITH AT LEAST TWO PARTS

FIELD OF THE INVENTION

The present invention relates to a screw spindle pump comprising at least two parts.

BACKGROUND OF THE INVENTION

A screw spindle pump is a so-called displacement pump, wherein the form of the rotating displacer resembles that of a spindle screw. The screw spindle pump comprises two or more contrarotating rotors and a pump housing which encloses the rotors. The rotors are constituted with a regular threaded profiling and engage with one another in a cog-wheel-like manner. The rotors are also referred to as screw spindles and comprise at least a first shank section and a profiled section with a screw-like or helical profile. The hollow spaces, which are formed by the at least three structural elements—pump housing, first screw spindle and second screw spindle, form the delivery spaces for the delivered medium. When the screw spindles are rotated, the delivery spaces move in a machine direction and deliver the medium inside the pump housing from the suction side (=inlet channel) to the pressure side (=outlet channel).

This type of pump is particularly well suited for incompressible as well as viscous media and for generating high pressures. Screw spindle pumps are used for the transport of single-phase as well as multi-phase fluids. The three-spindle screw spindle pump is used predominantly for pumping lubricants that are free of abrasive materials. They are characterised in particular by the fact that it is possible to generate high pressures up to 160 bar with them.

In the case of three-spindle screw spindle pumps, the three spindles are usually disposed in such a way that a drive spindle lying in the middle (also referred to as the male screw) drives two laterally engaging female screw spindles. The drive spindle, for its part, is connected to a drive motor, which can be constituted both as an electric motor and as an internal combustion engine. In embodiments known from the prior art, the torque generated by the drive is transmitted from the drive spindle via the spindle profile to the driven spindles. The spindle profiles engaging with one another produce closed delivery chambers, in which the delivery medium is enclosed and transported in the axial direction from the suction side to the pressure side.

In order to reduce the loads acting on the male screw, the female screws can be positioned, proceeding from the rotational axis of the male screw, at an angle of 180° in the pump housing, which balances out the radial force effect on the male screw.

Pumps in which fluid is transported by means of the pump with the application of pressure via a stationary inlet to an outlet are already known in the prior art.

Such a pump is known for example from WO 2011/063870 A2. WO Offenlegungsschrift shows a screw spindle pump with a pump housing and a flange section, wherein the flange section is constituted as a stationary component of the pump housing. The pump housing must therefore be aligned, together with its flange section, with respect to the position of the corresponding mating flange.

The problem of the invention, therefore, is to make available a screw spindle pump which displays greater flexibility with regard to its possible installation.

The aforementioned problem is solved by a screw spindle pump in accordance with the present invention.

SUMMARY OF THE INVENTION

The invention relates to a screw spindle pump for pumping delivery media, said screw spindle pump comprising at least two parts. In preferred embodiments, the delivery media are constituted by fluid media, such as lubricants, water, suspensions or suchlike. In connection with the present invention and the screw spindle pump according to the invention, the term "pumping" is understood to mean a process in which the delivery medium is transported and subjected to pressure.

The first of the at least two parts of the screw spindle pump comprises a housing and at least one spindle system disposed in the housing and driven in a rotational manner. The spindle system comprises a male drive spindle, which is coupled with one or more further female spindles driven in a rotational manner by the male drive spindle. In particular, the male drive spindle is coupled with the respective female spindle by the respective spindle profile following the law of gearing.

The male drive spindle is preferably driven by one or more actuators. The one or more actuators can be constituted for example as an electric motor and/or an internal combustion engine. In various embodiments, the rotation frequency of the male drive spindle is preselectable in a defined manner via the one or more actuators and can be adapted if need be to the given delivery medium and the desired delivery rate.

Furthermore, the first part comprises a pressure region downstream of the spindle system and at least one outlet opening connected to said pressure region, said outlet opening discharging the delivery medium out of the pressure region. The delivery medium is thus delivered via the spindle system into the pressure region. The outlet opening is constituted for example as a bore in the housing and/or as a channel in the housing. It is conceivable, for example, for the outlet opening to be constituted as a passage in the housing emerging into the pressure region and set angled against the rotational axis of the male drive spindle. According to a further embodiment, the outlet opening is constituted as a passage emerging into the pressure region and lying perpendicular to the rotational axis of the male drive spindle.

Furthermore, the second part of the screw spindle pump comprises at least one low-pressure chamber upstream of the spindle system and at least one inlet opening for the fluid medium into the low-pressure chamber. With regard to their diameter, it is conceivable for the at least one outlet opening and the at least one inlet opening to be constituted identically or differently. The second part and the first part are connected to one another preferably in a sealed the manner, so that no delivery medium can unintentionally escape from the low-pressure chamber of the screw spindle pump.

According to the invention, provision is made such that the first part and the second part of the screw spindle pump are coupled together, preferably in a rotational manner, so that they can assume at least two different relative positions.

For example, it is conceivable for the inlet opening and the outlet opening to be constituted as an inlet channel and as an outlet channel, wherein a parallel course of the inlet channel and the outlet channel is constituted in a first relative position. Furthermore, it may be the case that, in the second relative position, a skewed course of the inlet channel and the outlet channel is constituted.

Furthermore, it is conceivable for the first part and the second part to be connected to one another detachably in the given relative position. For example, it is conceivable for the detachable connection to take place by screw joints or suchlike. In addition, it is conceivable, during the operation of the screw spindle pump, for the first and the second part to be held in the given relative position for example by shrink joints and/or adhesive joints and/or weld joints. In preferred embodiments, it may be the case that the first part and the second part are connected together detachably in their given relative position during an operation of the screw spindle pump.

In preferred embodiments, the first part and the second part are coupled with one another in a rotational manner. For example, it is conceivable for the housing to have at least in sections a cylindrical shape and for the relative rotational movement of the first and second part to be able to be produced about a longitudinal axis of the cylindrically shaped housing or housing part.

It is also conceivable for the second part of the screw spindle pump to sit in a rotational manner on the first part. For example, one of the two parts comprises contact means for this purpose and the other of the two parts comprises corresponding counter-contact means, wherein the contact means and counter-contact means engage with one another as required.

It is also conceivable that a change from a first of the at least two relative positions into a second of the at least two relative positions can be brought about by means of a relative rotational movement of the first part with respect to the second part around a longitudinal axis, which longitudinal axis is constituted as the rotational axis of a male drive spindle of the spindle system. The male drive spindle can, as already mentioned previously, be defined as the spindle which is coupled with the drive by an actuator, such as for example an electric motor and/or internal combustion engine. Alternatively, embodiments are possible in which the longitudinal axis is constituted as the rotational axis of another of the spindles.

In particular, embodiments have proved successful in practice wherein the low-pressure chamber of the second part has at least in sections a shell-like shape. The flow behaviour of the delivery medium in the second part of the screw spindle pump is improved by means of this shaping.

Furthermore, it is conceivable for a flange section for fixing to a corresponding mating flange to be constituted in the region of the inlet opening and/or in the region of the outlet opening. The flange section in the region of the inlet opening or the flange section of the second part is thus preferably rotated together with the first part in the presence of a relative rotational movement of the second part with respect to the first part.

In order to limit excess pressure in the pressure region, it is possible with various embodiments for the first part to comprise at least one return channel, which at least one return channel is in fluidic communication with the pressure region and with the low-pressure chamber. For example, it is conceivable for the return channel to be constituted for conveying the delivery medium from the pressure region into the low-pressure chamber. In further embodiments, a plurality of such return channels for example are provided, which run parallel with one another, as the case may be. Embodiments have proved to be particularly successful in practice wherein one or more return channels are aligned parallel with a rotational axis of one or more drive spindles. It is also conceivable for the return channel to lead from the pressure region in the direction of the low-pressure chamber and to be closed at an end pointing in the direction of the low-pressure chamber. It is also conceivable for the return channel to comprise for example branching and/or a deflection, which deflection leads in the direction of one or more means for limiting a predefined set-point pressure level in the pressure region, said means being described in greater detail below.

In order to be able to integrate the at least one return channel in the simplest possible way during the production of the screw spindle pump, it is for example possible for the at least one return channel to be constituted through the housing of the first part. The at least one return channel is constituted for example as a bore in the housing, which extends from the pressure region up to the low-pressure chamber.

In particularly preferred embodiments, the screw spindle pump comprises one or more means which are brought into an operative connection with the low-pressure chamber and the pressure region, in such a way that a predefined maximum pressure level in the pressure chamber can be set by one or more means when a predefined pressure level is exceeded in the pressure chamber. It is conceivable for such means to be disposed in the region of the low-pressure chamber. It is also conceivable for the means to comprise one or more pressure relief valves.

Especially in the case of embodiments with the previously described at least one return channel, there is the possibility of the means being brought into an operative connection with the low-pressure chamber and the pressure region and of being constituted as a component of the second part of the screw spindle pump. In this embodiment, therefore, the means can be moved together with the second part as a component of the second part when there is a relative rotational movement of the first part and the second part.

It is for example conceivable for the previously mentioned at least one return channel to comprise branching, wherein a branch conveys the delivery medium onward to the one or more means.

The one or more means can comprise a base body with a hollow space, in which a piston is mounted with a stroke motion against the restoring force of a compression spring, as well as at least one bore disposed at the end face in the base body. A bolt coupled with the piston can be guided preferably coaxial with the piston through the bore and be in contact with the given delivery medium. The maximum cross-section of the bolt is preferably constituted reduced in terms of its area to the maximum cross-section of the piston. The maximum cross-section of the bolt is preferably constituted reduced in terms of area to the minimum cross-section of the piston.

Moreover, it is possible for the bore to be constituted as a component of a front cover of the base body and for the cover to comprise one or more further apertures preferably disposed radially around the bore for the entry of the delivery medium into the hollow space of the base body. After entry via one or more further bores, the delivery medium can come directly into contact with the piston and in particular with a head section of the piston, described in greater detail below, and can press the latter, thereby assisting the bolt, against the restoring force of the spring away from the one or more bores.

When the piston moves or when the piston performs a stroke motion, the delivery medium is able to penetrate into a hollow space of the base body that becomes accessible due to the stroke motion, as a result of which a pressure reduction in the pressure region or in the low-pressure chamber results.

In principle, the one or more means can be constituted as a valve, wherein the valve comprises a base body, a piston, a compression spring and a so-called pilot system. The pilot system serves to reduce the pressure in a pressure region by opening and closing the valve when a maximum pressure level is exceeded. With this embodiment, the opening takes place by the pressure applied by a control bolt. If pressure is present at an opening bore of the valve, a pressure relief in the pressure region is produced by opening the valve by means of the control bolt. The control bolt is hereby brought into contact with the previously mentioned piston and preferably has a smaller cross-sectional area than the piston, as a result of which a reinforcing effect results when the valve is opened.

When the pressure in the pressure region falls, the piston in the described embodiment is moved by the force of the compression spring into a seat of the valve and closes the pressure opening through which the control pin is guided. At the same time, an aperture or channel disposed laterally in the base body is opened, said aperture or channel being connected to the low-pressure chamber. The pressure level in the base body is thus reduced when the aperture or the channel is opened and adapted to the pressure level of the low-pressure chamber.

There is therefore the possibility for the one or more means to comprise, as appropriate, a base body with a hollow space, in which a piston is mounted with a stroke motion against the restoring force of a compression spring and a bolt connected to the piston, the maximum cross-section of said bolt being constituted reduced in area to the maximum cross-section of the piston, is guided with a stroke motion in the base body when a predefined maximum pressure level is exceeded. Resulting from the stroke motion, a lateral opening of the base body is preferably cleared for the return flow of the delivery medium from the pressure region into the low-pressure chamber.

It is therefore also conceivable that, when the maximum pressure level in the pressure region is not exceeded, a head section of the piston is guided by means of the compression spring into a seat and the hollow space of the base body is brought into fluidic communication with the low-pressure chamber via the opening disposed laterally in the base body, so that the pressure level in the hollow space of the base body is essentially identical to the pressure level in the low-pressure chamber.

It is also conceivable for the one or more means to be constituted as a component of the second part and to comprise a rear cover, which can be removed by means of one or more screw joints and which is disposed at an outer side of the second part.

The possibility also exists for the one or more means to comprise one or more adjusting means for selecting the restoring force of the compression spring, said adjusting means being accessible from the exterior and preferably operable by means of a tool. For example an external square key or suchlike. An adaptation of the maximum pressure level in the low-pressure chamber or in the pressure region advantageously takes place simply by operating the one or more adjusting means from the exterior, without a replacement of components having to be made.

BRIEF DESCRIPTION OF THE DRAWINGS

Examples of embodiment of the invention and its advantages are explained in greater detail below with the aid of the appended figures. The size ratios of the individual elements with respect to one another in the figures do not always correspond to the actual size ratios, since some forms are represented simplified and other forms magnified compared to other elements for the sake of better clarity.

DETAILED DESCRIPTION OF THE INVENTION

Identical reference numbers are used for identical or identically acting elements of the invention. Furthermore, for the sake of clarity, only reference numbers that are required for the description of the given figure are represented in the individual figures. The represented embodiments only represent examples as to how the screw spindle pump according to the invention can be constituted and do not represent a conclusive limitation.

Figure 1:
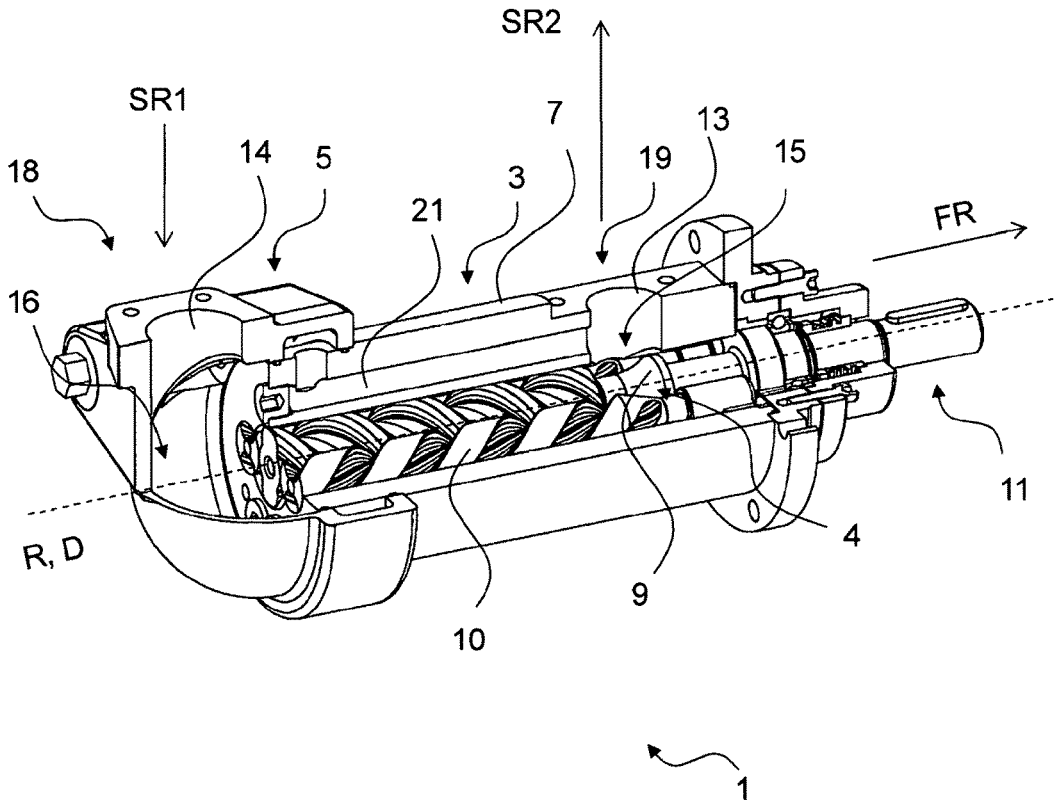
FIG. 1 shows a diagrammatic perspective view of an embodiment of a spindle screw pump according to the invention.

FIG. 1 shows a diagrammatic perspective view of an embodiment of a screw spindle pump 1 according to the invention. Screw spindle pump 1 is constituted by a first part 3 and a second part 5. First part 3 comprises a housing 7. Disposed in housing 7 is a spindle system 4, which in the present case comprises a male drive spindle 9 and two further female spindles, whereof one female spindle 10 can be seen in FIG. 1. First female spindle 10 and the further female spindles are coupled in a rotational manner with male drive spindle 9 and form, with an operative connection to the male drive spindle, moving delivery chambers for the transport of a delivery medium in delivery direction FR. Male drive spindle 9 is coupled at its free end 11 emerging from housing 7 of first part 3 with an actuator (not represented), such as for example an electric motor. Rotational axis R of male drive spindle 9 is also indicated.

First part 3 comprises a pressure region 15 and an outlet opening 13, which is brought into connection with pressure region 15 thereby discharging the delivery medium from pressure region 15. The delivery medium thus flows from pressure region 15 and via outlet opening 13 out of housing 7 of first part 3. In the present case, pressure region 15 is defined as the region via which the delivery medium is passed on from spindle system 4 to outlet opening 13. In further embodiments, a screw spindle pump 1 can also comprise one or more pressure chambers, which are disposed upstream of outlet opening 13.

The embodiment of FIG. 1 also comprises a return channel 21 as a component of screw spindle pump 14. Return channel 21 is constituted through housing 7 of first part 3 and is introduced as a bore into housing 7 during the production process of housing 7. Only one such return channel 21 is represented, but in other embodiments a plurality of such return channels 21 can also be introduced into housing 7.

Return channel 21 connects pressure region 15 of first part 3 to low-pressure chamber 16 of second part 5, but is closed in the region of low-pressure chamber 16, so that the delivery medium cannot flow back from pressure region 15 into low-pressure chamber 16. As described in greater detail below in FIG. 6, the delivery medium is conveyed through return channel 21 into a pressure chamber 43 and respectively 43', which is constituted as an annular channel, wherein a valve 2 (see FIG. 5) is connected to each pressure chamber 43 and 43' respectively.

FIG. 1 shows an embodiment in which outlet opening 13 is constituted as an outlet channel, wherein return channel 21 has an orthogonal orientation to the outlet channel and outlet opening 13 and is connected to outlet opening 13 and the outlet channel. The pressure region thus extends into outlet opening 13 and into the outlet channel. Return channel 21 runs as a bore parallel to rotational axis R of male drive spindle 9.

Screw spindle pump 1 also comprises at least one low-pressure chamber 16 disposed upstream of spindle system 4, said low-pressure chamber being constituted shell-shaped in FIG. 1. By means of the shell-shaped embodiment, the flow behaviour of the delivery medium entering as a volume flow into low-pressure chamber 16 and its onward passage to spindle system 4 is optimised.

An inlet opening 14 of second part 5 is also represented. The delivery medium enters via inlet opening 14 into low-pressure chamber 16. Disposed in the region of inlet opening 14 and in the region of outlet opening 13, in each case, is a flange section 18 and respectively 19 for fixing to a corresponding mating flange (not represented).

First part 3 and second part 5 are coupled together in a rotational manner so they can assume two different relative positions. For this purpose, second part 5 sits in the present case on first part 3.

FIG. 1 shows a first relative position of first and second part 3 and 5, wherein the delivery medium flows in a first flow direction SR1 through inlet opening 14 into low-pressure chamber 16 and in a second flow direction SR2 through outlet opening 13 out of housing 7 of first part 3, wherein first flow direction SR1 and a second flow direction SR2 run parallel with one another. Rotational axis R of male drive spindle 9 is also constituted as rotational axis D for the relative rotation of first and second part 3 and 5. Flange sections 18 and 19 of first and second part 3 and 5 can thus be matched, by means of a relative rotation of first and second part 3 and 5, to the position of a corresponding mating flange. A higher degree of flexibility with such an embodiment of a screw spindle pump 1 according to the invention is thereby ensured.

Figure 2:
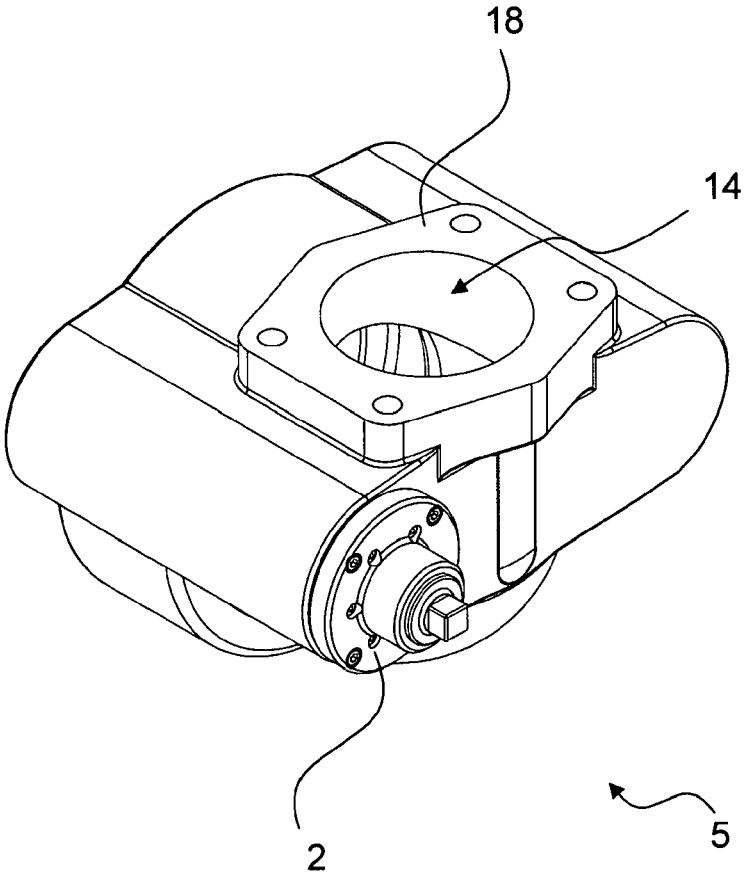
FIG. 2 shows a diagrammatic perspective view of the second part of the screw spindle pump from FIG. 1.

FIG. 2 shows a diagrammatic perspective view of second part 5 of screw spindle pump 1 from FIG. 1. Flange section 18 and inlet opening 14 of second part 5 can again be clearly seen in FIG. 2. A valve 2 is also represented, which is also constituted as a component of second part 5 and which valve 2 will be dealt with below in detail in FIG. 5. Valve 2, inlet opening 14 and flange section 18 can be rotated together with second part 5 as a component of second part 5 with a relative rotational movement of first part 3 (see FIG. 1) with respect to second part 5.

Figure 3A:
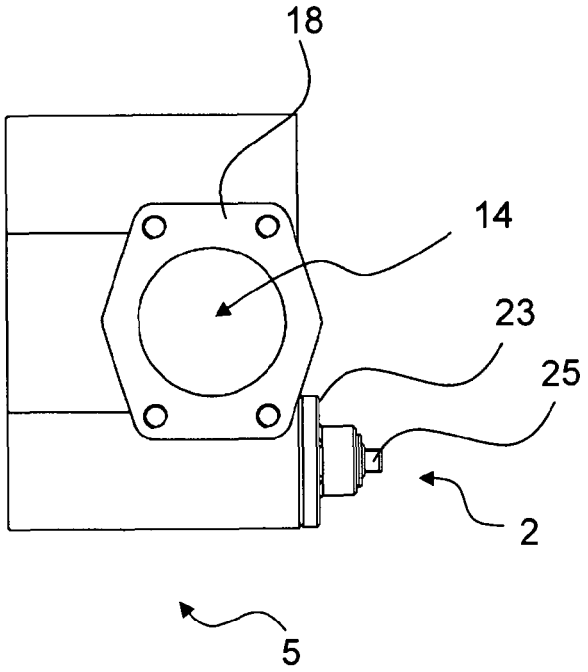
FIGS. 3A-3B show a diagrammatic plan view and a diagrammatic side view of the second part from FIG. 2.
Figure 3B:
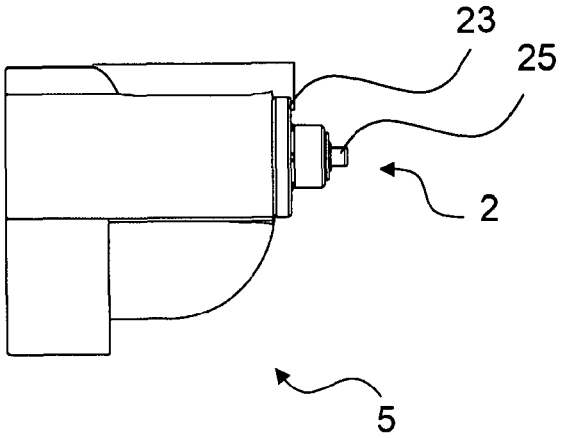

FIG. 3 show a diagrammatic plan view (FIG. 3A) and a diagrammatic side view (FIG. 3B) of second part 5 from FIG. 2. Flange section 18 and inlet opening 14 of second part 5 are again represented in FIG. 3A. A rear cover 23 and adjusting means 25 of valve 2 represented in detail in FIG. 5 can clearly be seen in FIG. 3. Rear cover 23 is disposed at an outer side of second part 5 and can be fixed there as appropriate by connections such as screws or suchlike and/or be accommodated in a form-fit manner in second part 5. The restoring force of compression spring 27 of valve 2 represented in FIG. 5 can be preselected or set by means of adjusting means 25, which is constituted accessible from the exterior and as an external square key.

Figure 4A:
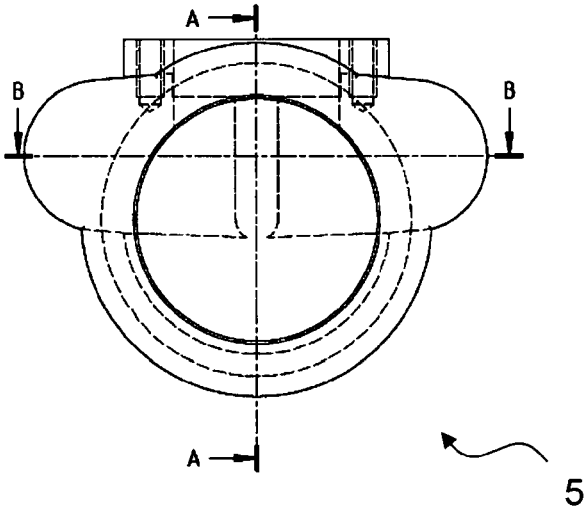
FIGS. 4A-4B show a diagrammatic front view of the second part from FIGS. 2 and 3 as well as a cross-section through the second part.
Figure 4B:
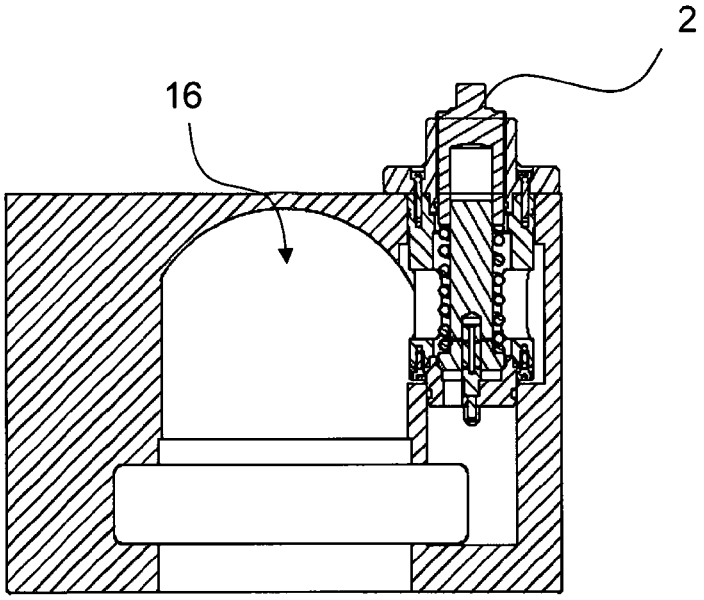

FIG. 4 show in FIG. 4A a diagrammatic front view of second part 5 from FIGS. 2 and 3. Also represented in FIG. 4B is a cross-section through second part 5 along intersecting line B-B in FIG. 4A.

The cross-section of FIG. 4B again illustrates the arrangement of valve 2 in second part 5. As represented in FIG. 4B, low-pressure chamber 16 and the valve are brought into fluid communication with one another for passing on the delivery medium. The delivery medium can be passed on for example via a return channel 21 (see FIG. 1) to valve 2.

Figure 5:
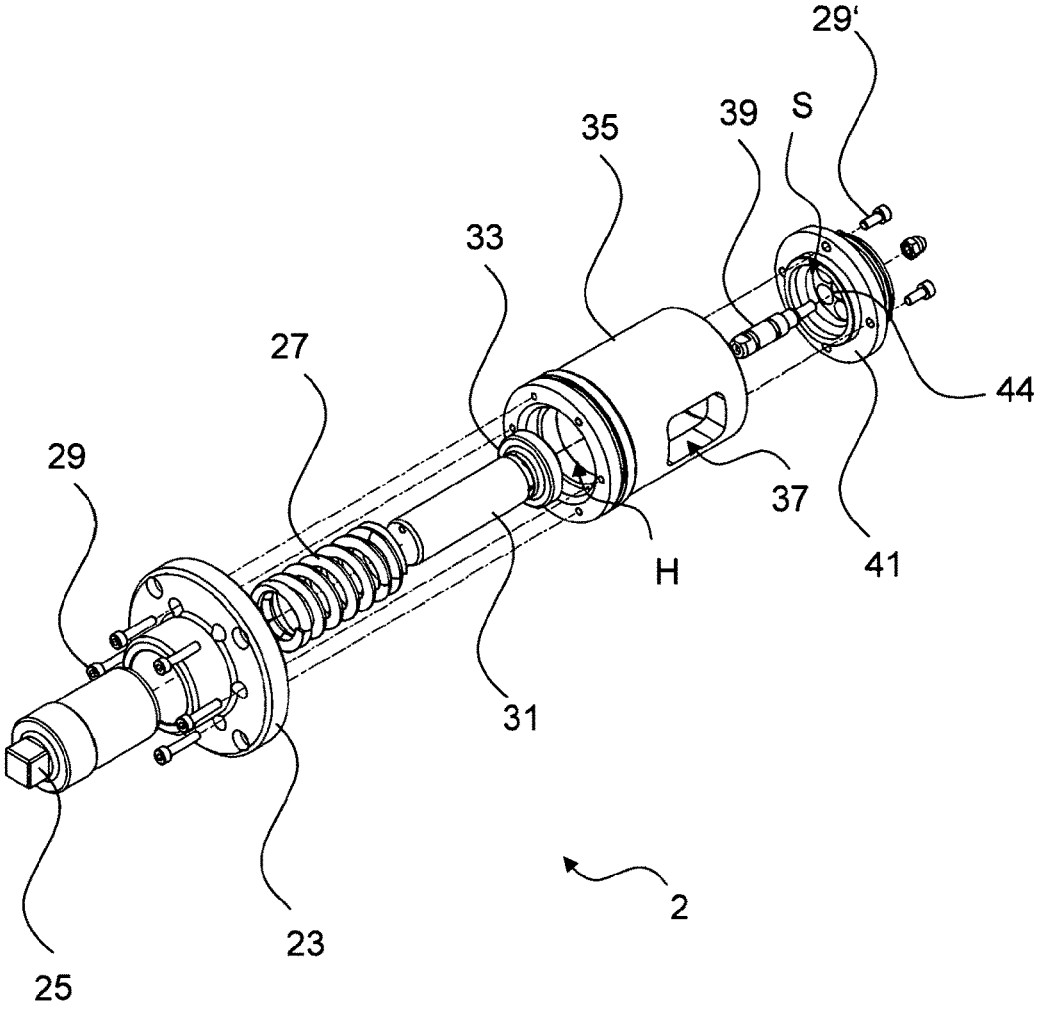
FIG. 5 shows a valve for adjusting a maximum pressure level in the pressure region of the screw spindle pump from FIG. 1.

FIG. 5 shows a valve 2 for adjusting a maximum pressure level in pressure region 15 of screw spindle pump 1. Valve 2 is constituted as a so-called pressure relief valve or safety valve. Valve 2 is a component of second part 5. With a relative rotation of first part 3 and of second part 5, a rotational movement of valve 2 together with second part 5 also takes place.

With regard to its function, valve 2 is constituted in such a way that a predefined maximum pressure level in pressure region 15 can be produced by valve 2 when a predefined pressure level in pressure region 15 is exceeded.

In the example of embodiment of FIG. 5, valve 5 comprises a base body 35 with hollow space H. In hollow space H, piston 31 is mounted with a stroke motion against the restoring force of a compression spring 27. A plurality of bores 44 are represented in a front cover 41 of base body 35, wherein the control bolt 39 passed through cover 41 guides piston 31 coaxially via the bore provided at the end face. In the present case, control bolt 39 is fixed by a central bore 44 in cover 41, wherein a plurality of further apertures or bores 44 are provided radially around the central bore in cover 41 of base body 35.

As can be seen in FIG. 5, the maximum cross-section of bolt 39 normal to the respective longitudinal axis is constituted reduced in the area to the maximum cross-section of piston 31.

Piston 31 also comprises a head section 33 at a free end pointing in the direction of bore 44. Head section 33 is accommodated play-free in hollow space H of base body 35 in the assembled state of valve 2 or of the pressure relief valve. A lateral opening 37 in base body 35 is also represented, past which lateral opening head section 33 of piston 31 is conveyed when a stroke motion is performed.

Until the maximum pressure level in pressure region 15 is reached, piston 31 does not perform any stroke motion. Head section 33 is disposed in a seat S of front cover 41 as a result of a restoring force of compression spring 27. For example, seat S of front cover 41 can be such that head section 33 can be accommodated essentially play-free in seat S.

The delivery medium can penetrate through lateral opening 37. The pressure level of the delivery medium penetrating into lateral opening 37 is always identical to the actual pressure level in low-pressure chamber 15 or in pressure region 15. If piston 31 performs a stroke motion due to the maximum pressure level being exceeded and head section 33 of piston 37 leaves seat S, delivery medium with the excess pressure can penetrate through return channel 21, bore 44 and radially provided openings of control bolt 39 and additionally assist the stroke motion of piston 31 against the restoring force of compression spring 27 in order to open, following the delivery medium, the path into hollow space H of base body 35 via opening 37 into low-pressure chamber 16.

As already mentioned and as can be seen in FIGS. 3 and 4, rear cover 23 is disposed at the outer side of second part 5. The restoring force of compression spring 27 can be preselected by means of adjusting means 25.

The individual components of valve 2 can be fitted together by means of fixing means 29 also represented in FIG. 5—in the present case constituted as screw joints.

Figure 6A:
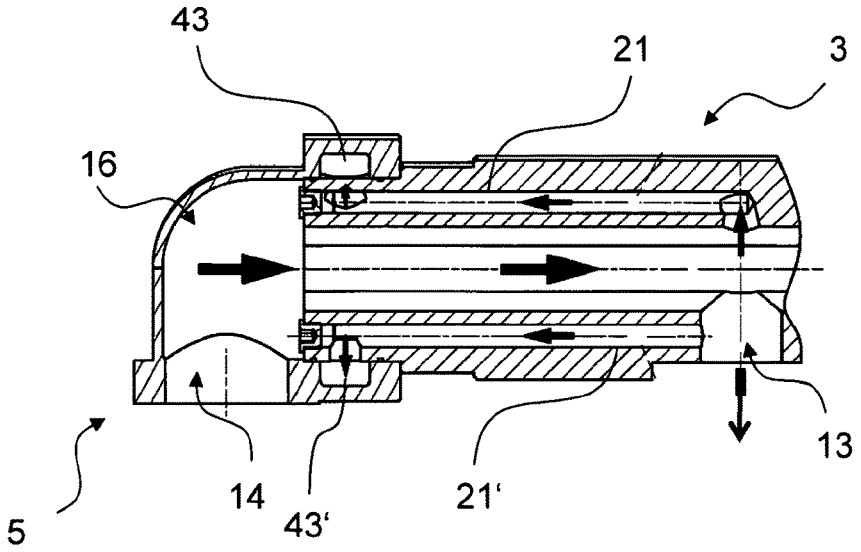
FIG. 6A-6B shows a possibility for the arrangement of the valve from FIG. 5 in a second part of an embodiment of a screw spindle pump according to the invention.

FIG. 6 show a possibility for the arrangement of valve 2 from FIG. 5 in a second part 5 of an embodiment of screw spindle pump 1 according to the invention FIG. 6A next illustrates by means of an arrow representation a possible option for the flow of the delivery medium. The delivery medium thus passes as a volume flow via inlet opening 14 into low-pressure chamber 16 of second part 5 and is then transported in the arrow direction via spindle system 4 (see FIG. 1) to outlet opening 13.

The embodiment of FIG. 6 comprises two return channels 21 and 21', which return channels 21 and 21' have a parallel course. Each of return channels 21 and 21' leads in the direction of a pressure chamber 43 and 43' respectively, wherein a valve 2 as represented by way of example in FIG. 5 is connected to each chamber 43 and 43' respectively.

Figure 6B:
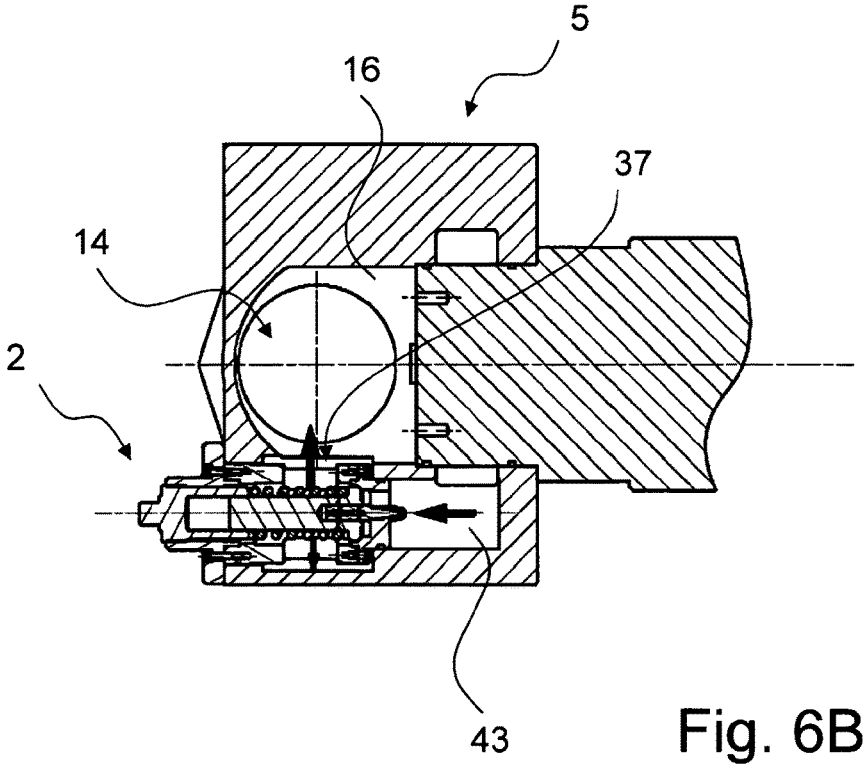

FIG. 6B also shows that the delivery medium can flow directly via opening 37 of valve 2 shown in FIG. 5 into low-pressure chamber 16 of second part 5. Furthermore, hollow space H of valve 2 or of base body 35 is in fluidic communication via opening 37 directly with low-pressure chamber 16.

The invention has been described by reference to a preferred embodiment. The person skilled in the art can however imagine that modifications or changes to the invention can be made without thereby departing from the scope of protection of the following claims.

The invention claimed is:

1. A screw spindle pump, comprising:

at least a first part and a second part, each for pumping delivery media such as lubricants, water, and suspensions;

wherein the first part comprises a housing and at least one spindle system disposed in the housing and capable of being driven in a rotational manner, a pressure region disposed downstream of the spindle system and at least one outlet opening, which is connected to the pressure region, said outlet opening discharging a delivery medium out of the pressure region;

wherein the second part comprises at least one low-pressure chamber disposed upstream of the spindle system and at least one inlet opening for the delivery medium into the low-pressure chamber;

wherein the first part and the second part are configured to be coupled together in at least two different relative positions; and wherein the second part includes a valve in operative connection with the low-pressure chamber and the pressure region, the valve configured to produce a predefined maximum pressure level in the pressure region.

2. The screw spindle pump according to claim 1, wherein the second part of the screw spindle pump sits in a rotational manner on the first part.

3. The screw spindle pump according to claim 1, wherein a change from a first of the at least two different relative positions into a second of the at least two different relative positions is brought about by relative rotational movement of the first part with respect to the second part around a longitudinal axis, which longitudinal axis is constituted as a rotational axis of a male drive spindle of the spindle system.

4. The screw spindle pump according to claim 1, wherein a flange section for fixing to a corresponding mating flange is constituted in at least one of (i) the region of the inlet opening and (ii) the region of the outlet opening.

5. The screw spindle pump according to claim 1, wherein the first part comprises at least one return channel, which return channel is brought into fluidic communication with the pressure region and with the low-pressure chamber.

6. The screw spindle pump according to claim 5, wherein the at least one return channel is passed through the housing of the first part.

7. The screw spindle pump according to claim 5, wherein the at least one return channel runs parallel with a rotational axis of one or more spindles of the spindle system.

8. The screw spindle pump according to claim 1, the valve including a base body with a hollow space, in which a piston is mounted with a stroke motion against a restoring force of a compression spring, and at least one control bolt connected to the piston, the maximum cross-section of which control bolt is constituted reduced in area to the maximum cross-section of the piston and which guides the piston with a stroke motion against the restoring force of the compression spring in the base body when a predefined maximum pressure level in the pressure region is exceeded, wherein, resulting from the stroke motion, a lateral opening of the base body is cleared for a return flow of the delivery medium from the pressure region into the low-pressure chamber.

9. The screw spindle pump according to claim 8, wherein at least one bore is formed in a cover of the base body, wherein the cover is arranged at an end of the base body on an advancing side of a delivery direction, and wherein the cover comprises one or more further apertures for entry of the delivery medium into the hollow space of the base body.

10. The screw spindle pump according to claim 8, wherein, when the maximum pressure level in the pressure region is not exceeded, a head section of the piston is guided by the compression spring into a seat and the hollow space of the base body is brought into fluidic communication with the low-pressure chamber via the opening disposed laterally in the base body, so that the pressure level in the hollow space of the base body is essentially identical to the pressure level in the low-pressure chamber.

11. The screw spindle pump according to claim 8, wherein the base body comprises a rear cover, which is removable by one or more screw joints, said cover being disposed at an outer side of the second part.

12. The screw spindle pump according to claim 8, wherein the valve includes one or more adjusters for selecting the restoring force of the compression spring, said adjusters being accessible from an exterior.

* * * * *